US005417026A

United States Patent [19]

Brumfield

[11] Patent Number: 5,417,026

[45] Date of Patent: May 23, 1995

[54] CORRUGATED BUILDING COMPONENTS

[76] Inventor: James W. Brumfield, 1895 Birch Ave., Richland, Wash. 99352

[21] Appl. No.: 56,680

[22] Filed: May 3, 1993

[51] Int. Cl.[6] ..... F04C 3/00

[52] U.S. Cl. ..... 52/591.4; 52/795; 52/797

[58] Field of Search ..... 52/262, 265, 264, 267, 52/266, 270, 272, 274, 284, 293.3, 592.1, 591.1, 591.4, 795-797

[56] References Cited

U.S. PATENT DOCUMENTS

| | | | |
|---|---|---|---|
| 140,526 | 7/1873 | Munson, Jr. | 52/796 |
| 944,592 | 12/1909 | Bonsall | 52/796 X |
| 3,051,277 | 8/1962 | Day, Jr. | 52/270 X |
| 3,285,644 | 11/1966 | Tomek | 52/272 X |
| 3,339,327 | 9/1967 | Kempf | 52/591.1 X |
| 3,421,279 | 1/1969 | Franc . | |
| 3,492,765 | 2/1970 | Behlen . | |
| 3,534,463 | 10/1970 | Molin et al. | 52/797 X |
| 3,798,852 | 3/1974 | Nicoll, Jr. . | |
| 3,867,239 | 2/1975 | Alesi et al. | 52/592.1 X |
| 3,886,706 | 6/1975 | Baker . | |
| 3,958,388 | 5/1976 | Hawes | 52/270 X |
| 4,004,385 | 1/1977 | Kosuge | 52/439 X |
| 4,095,388 | 6/1978 | Breault | 52/591.1 X |
| 4,358,916 | 11/1982 | Lacasse . | |
| 4,430,835 | 2/1984 | Enson | 52/264 X |
| 5,218,804 | 6/1993 | Campbell | 52/262 |

*Primary Examiner*—Lanna Mai

*Attorney, Agent, or Firm*—Wells, St. John, Roberts, Gregory & Matkin

[57] ABSTRACT

A corrugated building component and system includes a corrugated panel made up of fluted layers of sheet material. The flutes form open passages to receive connecting rods which may extend from one panel and into an adjacent panel, locking the panels together. The panels also include rabbeted edges that interfit, along with the connecting rods to produce a structural unit. A base plate or footing is described within the system with upright tie rods used to secure the assembled panels to the footing or base plate. Top, bottom, and end plates may be provided on sides and ends of elongated panels, to be joined with connecting members and reinforcing connectors.

18 Claims, 8 Drawing Sheets

CORRUGATED BUILDING COMPONENTS

TECHNICAL FIELD

The present invention relates to building systems and more particularly to building systems utilizing corrugated building components.

BACKGROUND OF THE INVENTION

There has been a constant need for portable shelters that are easily and quickly erected and that may be broken down for storage in a compact condition. Tents have been used in the past with only marginal success. The canvas or other flexible material does not provide adequate insulation, and the tent materials are quite heavy and awkward to handle.

Small, portable buildings have been designed and constructed in the past, some of which are readily assembled. However, the building components for such construction are quite heavy and bulky, thereby causing a storage problem.

The present building component and system provides an answer to the portable building problems presented above, through a system making use of corrugated material construction. Corrugated sheet material panels include internal fluted layers, the flutes of which form open channels. The panels are rabbeted at edges, and the channels are oriented with respect to the rabbeted edges such that successive panels may be connected together along the rabbeted edges and secured by connecting rods that extend through channels in one panel member into similar channels of the remaining panel member.

BRIEF DESCRIPTION OF THE DRAWINGS

Preferred embodiments of the invention are exemplified in the accompanying drawings, which are briefly described below.

DETAILED DESCRIPTION OF THE PREFERRED EMBODIMENTS

Figure 1:
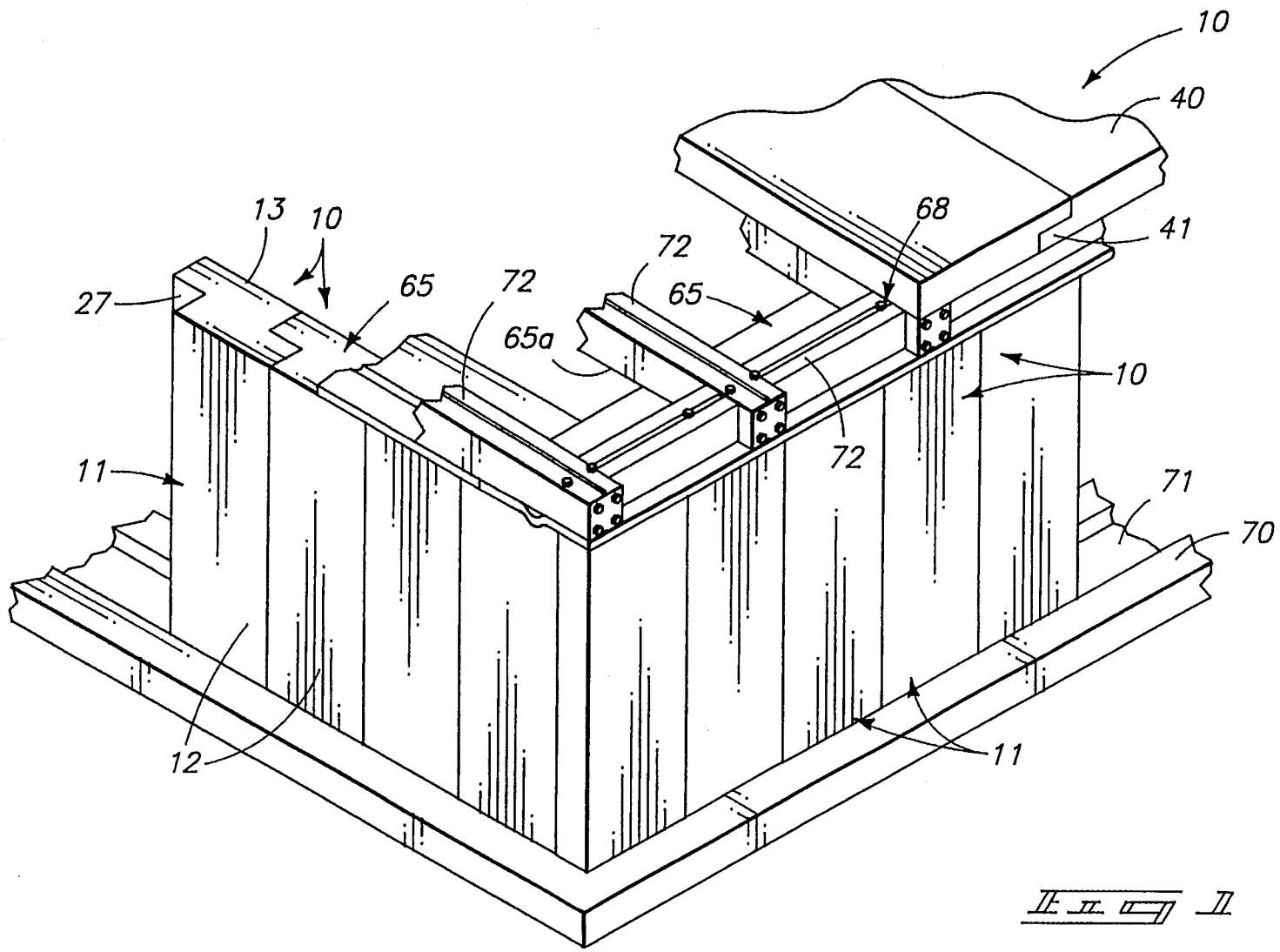
FIG. 1 is a perspective view of a wall construction using a first preferred form of the present invention.

This disclosure of the invention is submitted in furtherance of the constitutional purposes of the U.S. Patent Laws "to promote the progress of science and useful arts" (Article 1, Section 8).

A corrugated building component exemplifying features of the present invention is generally shown in the drawings by the reference numeral 10. The component 10 is formed of corrugated sheet material, using techniques and materials common to the corrugated board industry. In a preferred form, the corrugated sheets may be formed of paper which may be treated, as known in the industry, to resist moisture and corrosion. It may also be formed with various thickness layers, according to design requirements. Other materials including plastic may also be used, and produced in corrugated sheets for use with the present invention according to design requirements.

The present component in a first form includes a panel 11 with opposed face surfaces 12, 13 and individual material layers between the surfaces 12, 13, forming angularly oriented flutes. The flutes are arranged in layers (FIG. 4), including central flute layers 14, 15, and outward flute layers 16. Any desired number of flute layers may be used, depending on structural requirements or other design considerations. Further, the material itself may vary according to need and structural requirements as suggested above.

The first preferred panel configuration is substantially rectangular, including opposed end edges 23, 24, and intersecting side edges 25, 26. Other configurations (including curved) may also be used, though the rectangular panel configuration is preferred since the panel dimensions may closely approximate existing wood or wood product building components.

By way of example, a panel of approximately four by eight feet could substitute for standard construction sheet material such as plywood. In other preferred forms, however, the panels will be narrower than standard sheet size due to the manner by which the individual panels are connected together. A panel size might thus be two by eight feet, with the two foot dimension measured between the panel ends. The panel may also be provided in elongated, narrow configurations as a component of a beam or truss as exemplified in FIGS. 8–11, and as shown partially assembled in FIG. 1.

The panels are provided in the preferred form with rabbets 27 along at least one edge, and preferably opposed peripheral edges. The rabbets 27 are formed into the panels, with inside rabbet edges 28 (FIG. 4) parallel to the panel end edges, and surfaces 29 parallel to the panel outer surfaces 12, 13. The rabbet depth is preferably approximately half the panel thickness dimension (measured between the surfaces 12, 13). The preferred rabbet width dimension is approximately one half the panel surface 12, 13 width dimension. The actual panel width dimension will thus be greater than the width dimension of the panel surfaces 12, 13.

For example, a panel 11 with surfaces 12, 13 having a width dimension of two feet would actually be three feet wide, with one foot rabbet width dimensions. The rabbeted portions of one panel will overlap similarly rabbeted portions of adjacent panels, leaving only the surfaces 12, 13 exposed (FIG. 1).

The central flute layers 14, 15, in a preferred form, are parallel to one another and substantially perpendicular to the panel edges from which they originate and terminate. The flute layers define individual passages 22 that open at the end edges 23, 24 and at the inside edges 28 of the rabbets 27 at the center of the panel thickness dimension.

In the first preferred forms, the panels 11 include relatively flat side edges 25, 26. There are no rabbets formed along the side edges. However such rabbets could indeed be provided to enable extension of the panel structure in two dimensions.

Figure 3:
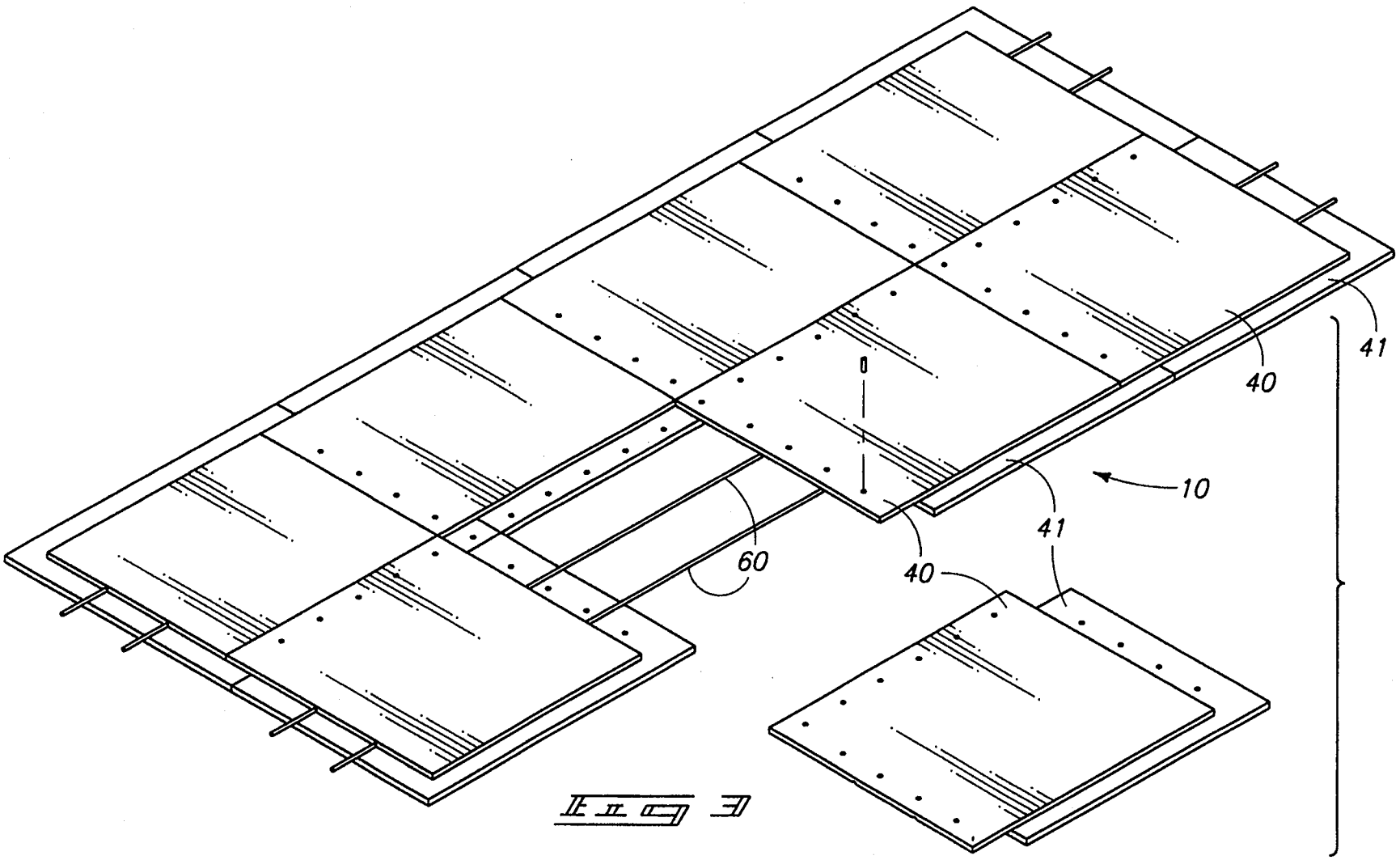
FIG. 3 is a perspective view of a second preferred form of the present invention.
Figure 7:
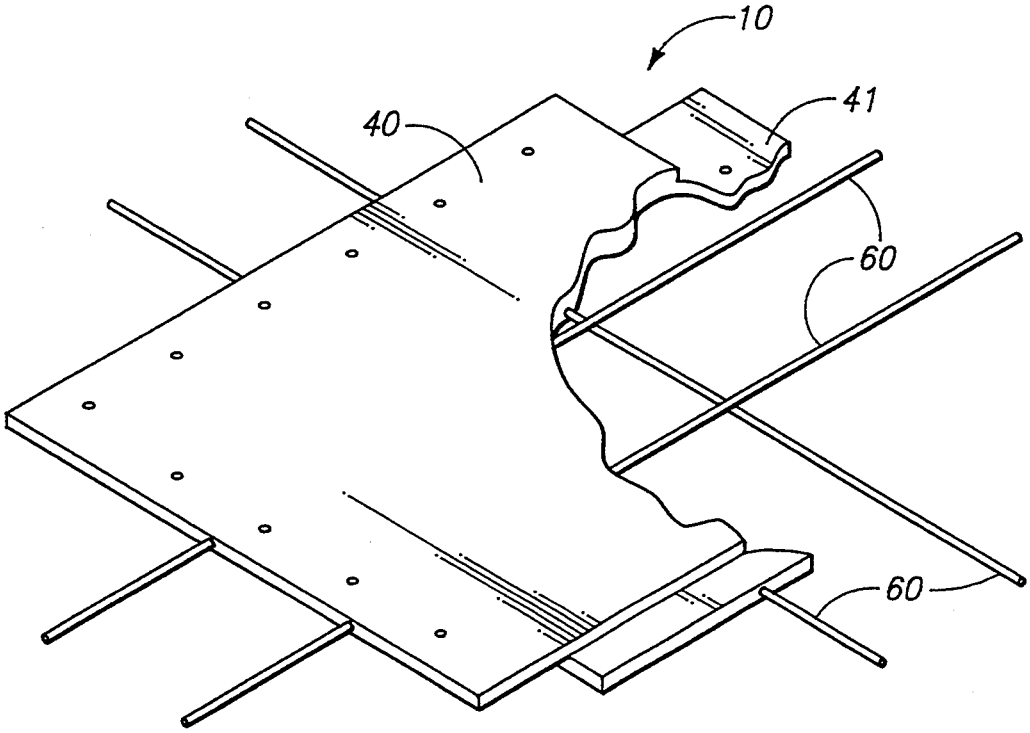
FIG. 7 is a fragmented view of a panel of the second preferred form.
Figure 8:
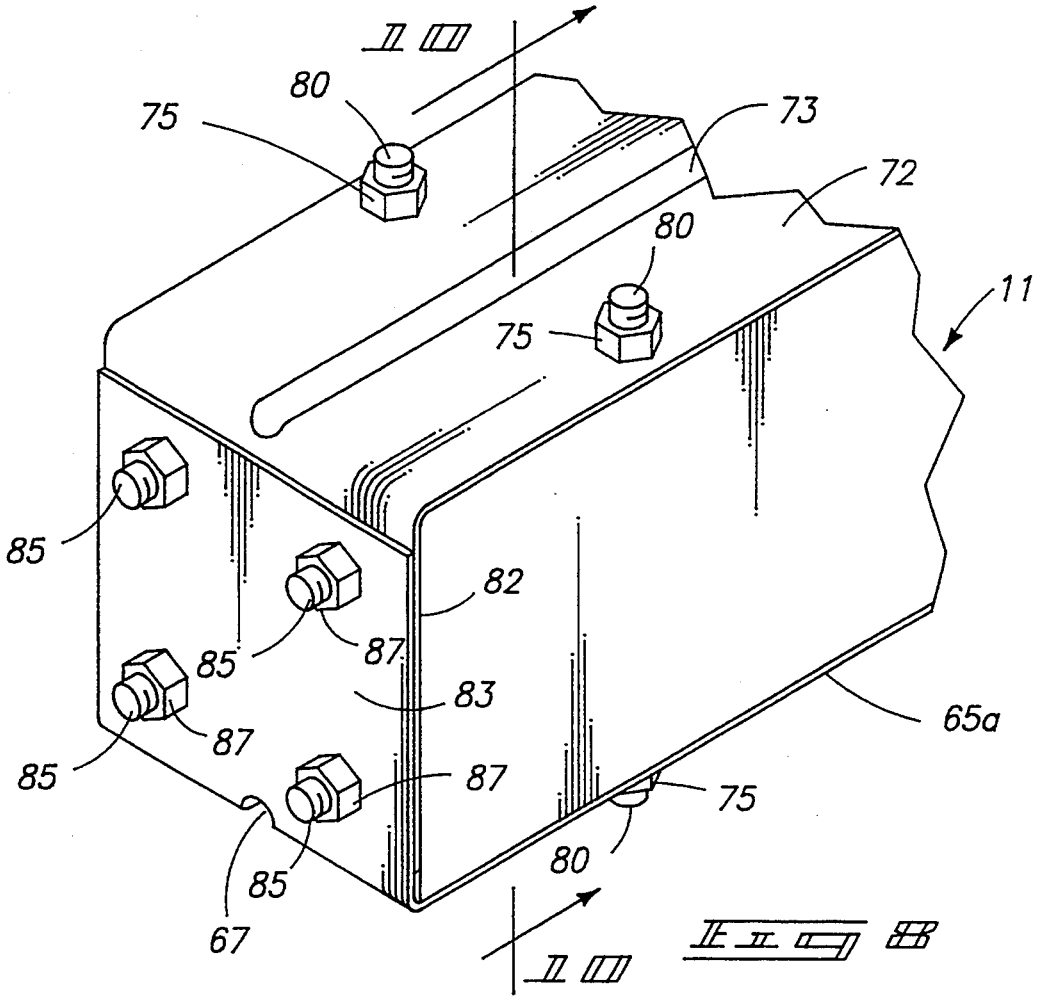
FIG. 8 is a fragmented view of a panel including top, bottom and end plate members in a beam or truss configuration.
Figure 9:
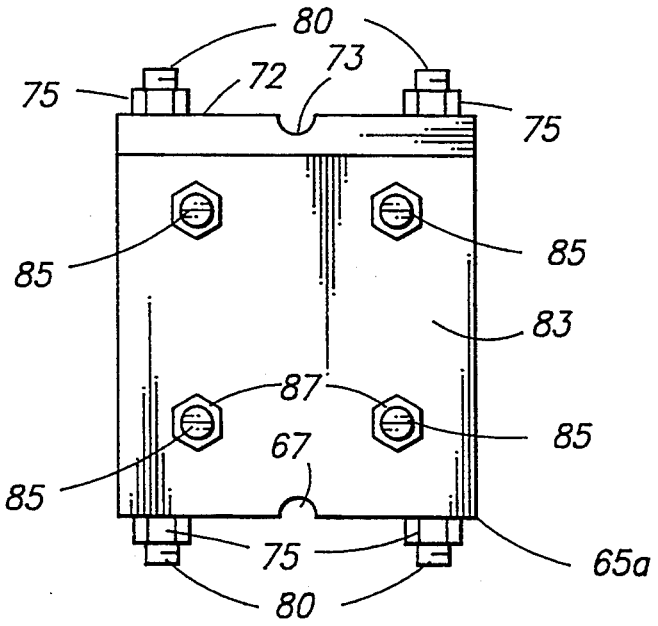
FIG. 9 is an end view of the embodiment shown in FIG. 8.
Figure 10:
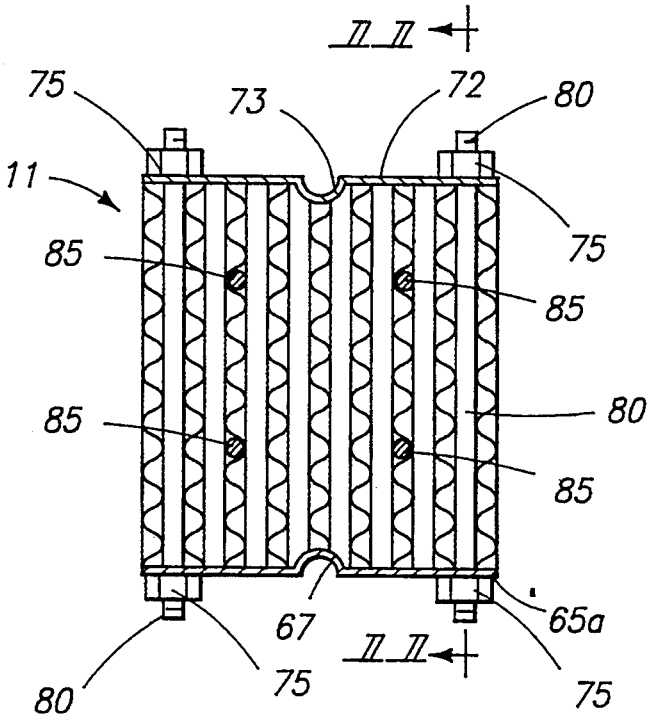
FIG. 10 is a sectional view taken along line 10—10 in FIG. 8.
Figure 11:
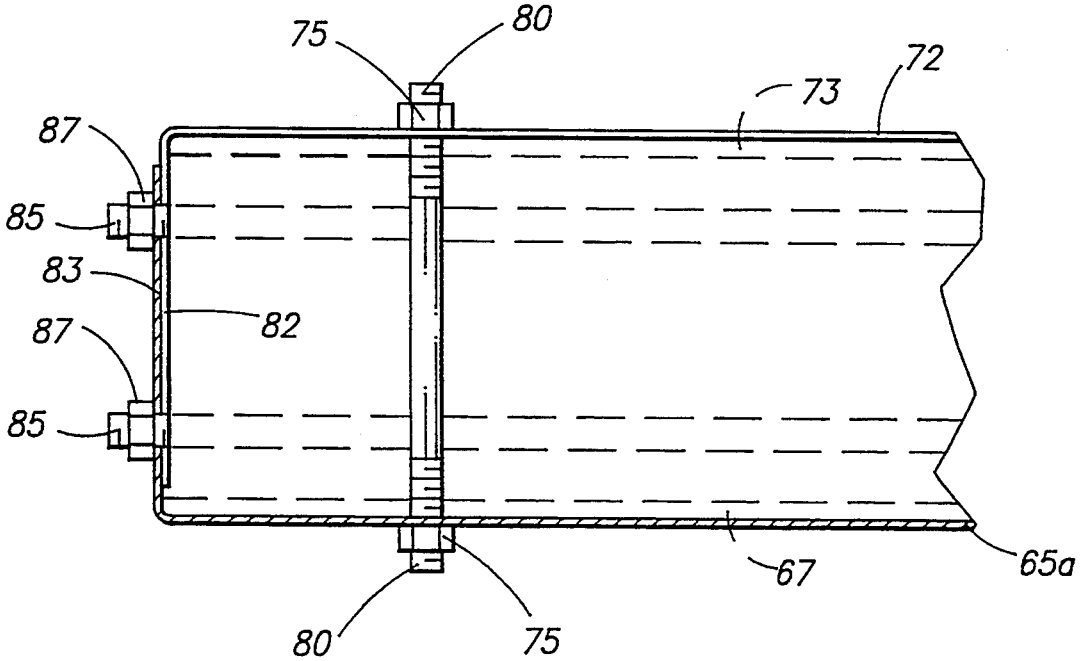
FIG. 11 is a sectional view taken on line 11—11 in FIG. 10.

FIGS. 3 and 7 exemplify a second preferred panel construction. In this form, the panel is comprised of first and second panel members 40, 41 overlapping one another and secured together in such a manner that rabbeted edges are formed about the entire panel periphery. The amount of overlap is equal on both sides and ends of the panel members. The rabbets on one side edge are thus of equal size to the rabbets on the opposite side edge. This allows the composite panels to be assembled with adjacent rabbeted sections overlapping to form large surface areas for ceilings, roof decking, flooring, large walls, etc. as shown in FIG. 3.

The nature of the rabbets permits the use of adhesives to secure successive panels together where more permanent, stable structures are desired.

The arrangement of flutes and layers (not shown in FIGS. 3 and 7 due to scale limitations) for the panel version shown in FIG. 3 may be substantially identical to that shown and described above with the exception that the central flute layers are preferably arranged in the laminated members 40, 41 at intersecting angles to receive connecting rods 60 in intersecting locking relation (FIG. 7).

A corrugated building system incorporating the present invention includes the panel construction described above, and means by which the panels are joined together.

The present system includes elongated connecting cables or rods 60 that are slidably received within the passages 22 of the panels. The rods are of sufficient length so part of the rod lengths are received in one panel and the remainder are received in aligned passages in an adjacent panel. In fact, the rods 60 may be of sufficient length to enable insertion through several panels. It is pointed out that the rods 60, instead of being rigid, elongated bars, could also be cables threaded through selected flute channels and pulled taut at ends to place the joined panels under compression.

Rods 60 serve to lock the panels together with the rabbeted surfaces joined to form a strong structural unit. In versions wherein peripheral rabbets are formed and panels are joined together to form a large surface area as shown by FIG. 3, two sets of rods angularly offset from one another may be used to even more securely lock the panels together. The rods are simply inserted through the aligned open ends of the passages 22 formed by the panel flutes. Conventional glue may also be used along the rabbet surfaces where more permanent or more stable construction is desired.

The system may also include a base plate 65 used as a footing or support. The same plate 65 may also be used as a header (FIG. 1). The base or header plates 65 may be formed of rolled or extruded metal. Each may be formed of an appropriately strong plastic, with a raised stiffener rib 67 formed along the length thereof. The base or header plate is of a length dimension approximately equal to the assembled panels to be supported above.

Figure 4:
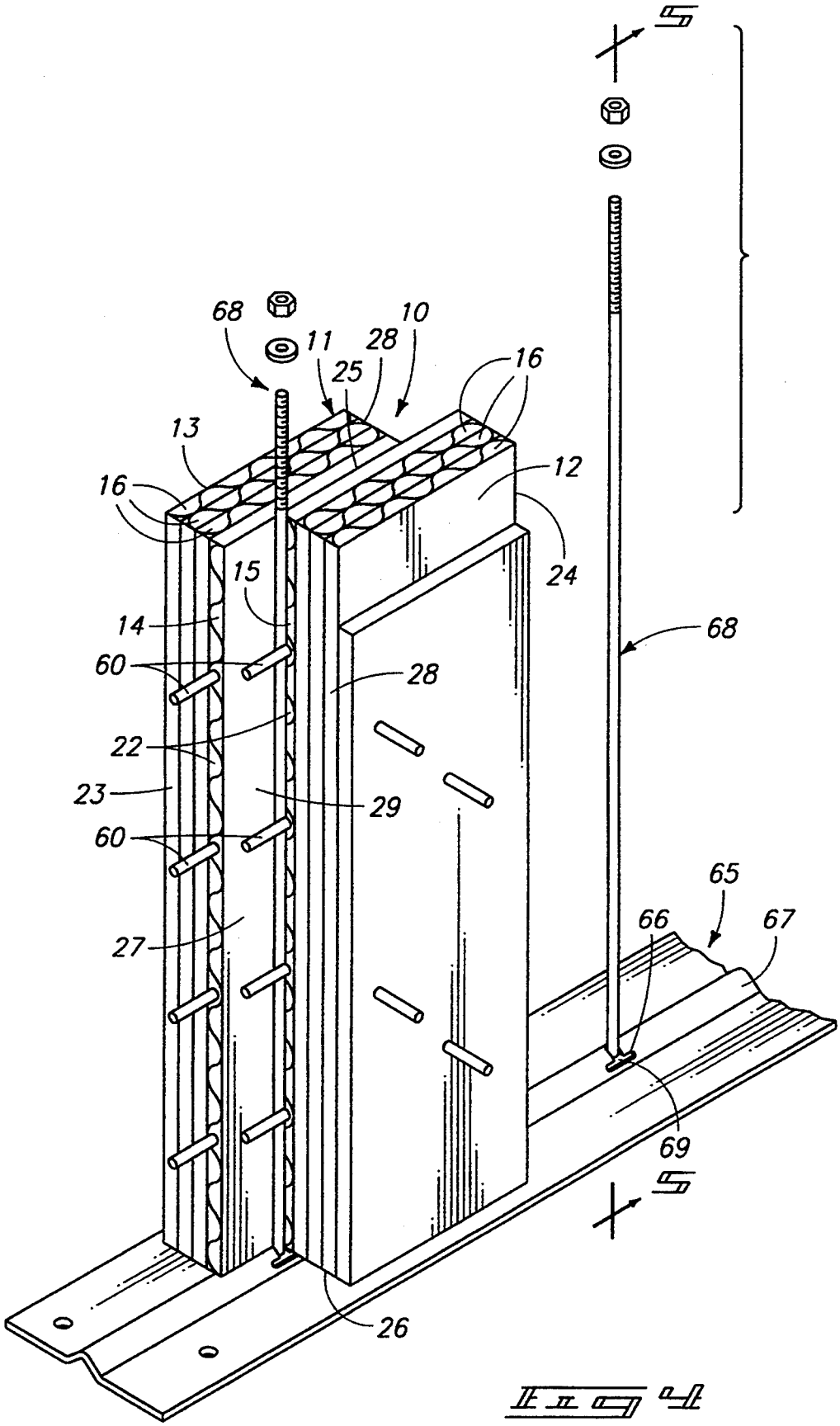
FIG. 4 is an enlarged perspective view similar to FIG. 2 only showing a base plate and tie bar.
Figure 5:
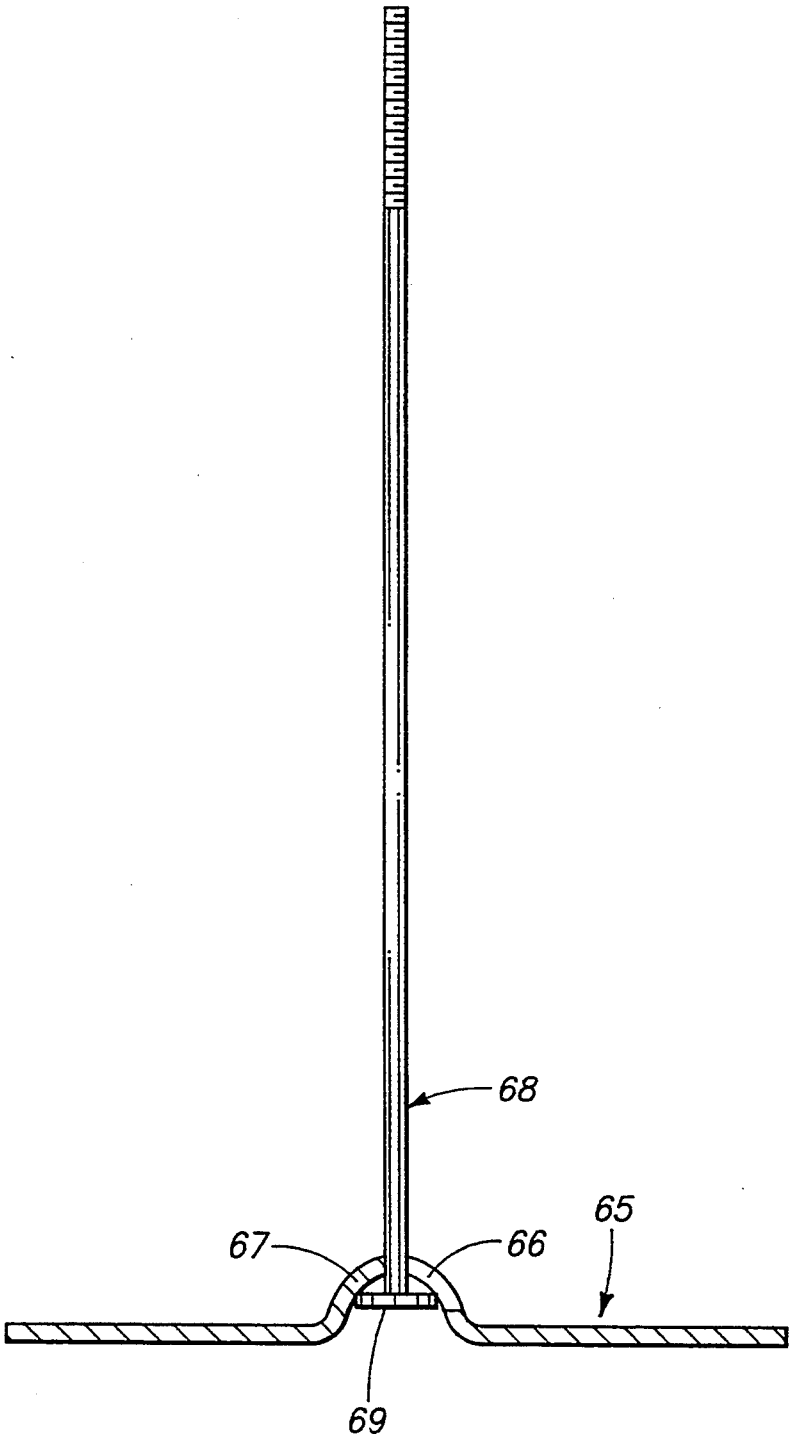
FIG. 5 is an enlarged sectional view taken on line 5—5 in FIG. 4.
Figure 6:
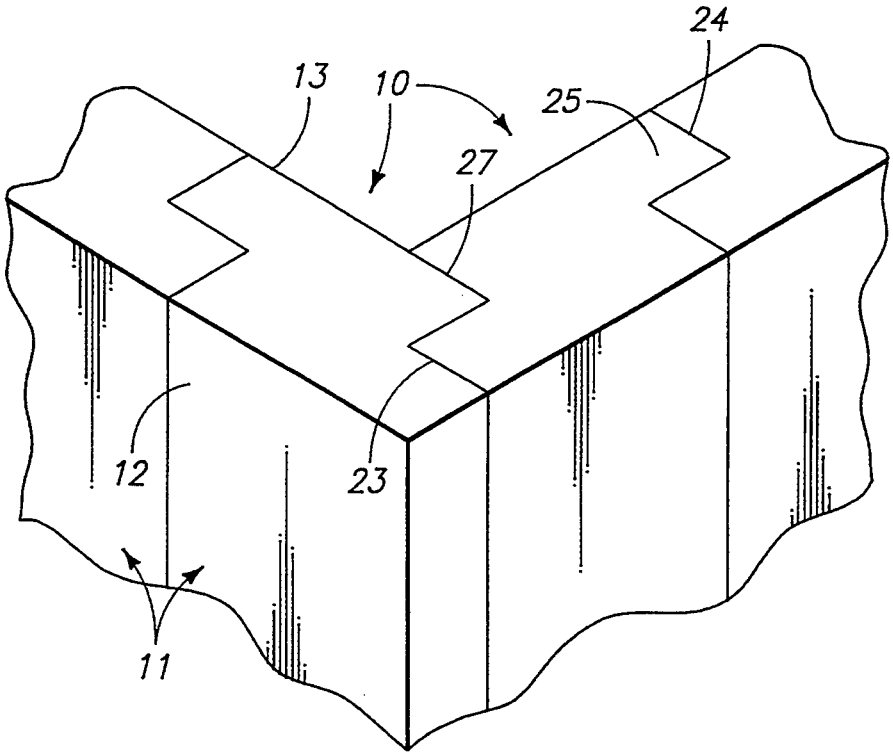
FIG. 6 is an enlarged diagrammatic view showing a corner and interconnection of several panels.

The base or header plate includes a series of "T" shaped slots 66 for receiving the headed ends 69 (FIG. 5) of elongated tie bars 68. The slots are spaced along the length of the plate by distances equal to spacing between rabbet edges on panels above. The bars 68 when mounted with their headed ends within the slots, will project upwardly and be received along the inside corners of the successive rabbets as shown in FIG. 4. The bars 68 could also be offset from the center of the panels and passed upwardly through the vertical panel passages 22 of one or more panels where closer spacing of the bars 68 is desired for greater structural stability.

Upper ends of the bars 68 may be threaded to receive nuts and washers. The nuts and washers may be used selectively to clamp the panels to the base plate (FIG. 4), or to clamp a header plate 65 to the wall as shown in FIG. 1. The bars may also extend through panel members provided in truss or beam form as shown in FIG. 1 and FIGS. 8–11.

An alternative to the base plate is a rather conventional concrete footing 70 (FIG. 2) in which a groove 71 is formed during pouring and forming of the footing surface. The groove receives the panel edges, and includes spaced upright tie bars 68 to be received along the inside corners of panel rabbets as shown. The bars may be positioned and held prior to pouring the concrete footing according to standard concrete working practice.

Figure 2:
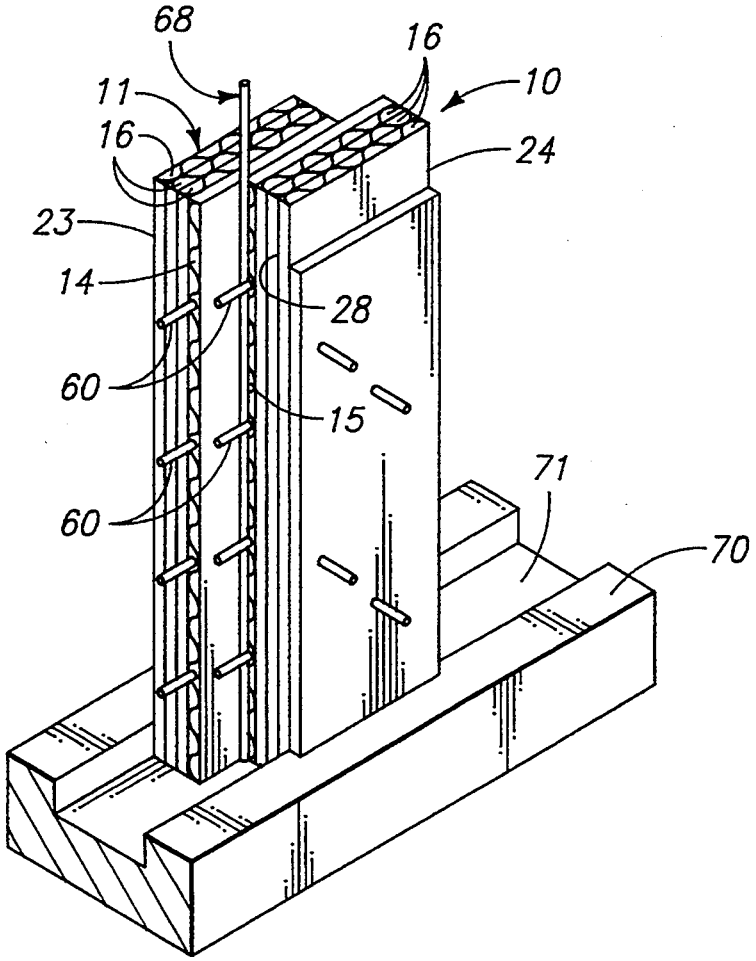
FIG. 2 is a fragmented perspective view of a portion of the construction shown in FIG. 1.

The assembled panels lend themselves to further covering as shown in FIGS. 2 and 4 where a portion of a wall board is shown being secured to the present panel members. Standard wallboard, paneling, or other structural or non structural inside or outside wall coverings could be easily utilized.

FIGS. 8–11 show a corrugated panel member 11 with a bottom plate **65*a* extending along its bottom longitudinal edge, and further including a top plate 72 (similar to the base or header plate 65) extending along its top longitudinal edge. Bottom plate 65*a* includes the longitudinal stiffener rib 67. Top plate 72 also includes a similar or identical rib 73 used to provide rigidity. The top plate 72 and bottom plate 65*a* are preferably secured by connecting members 80. Members 80 are preferably rods 81 that extend through upright flute channels of the panel member, with ends projecting through the plates 65*a*, 72 and threadably receiving nuts 75. End plates 82, 83 may be provided integrally with the top plate 72 and base plate 65*a* to engage opposite ends of the panel member. Longitudinal reinforcing connecting rods or cables 85 may be passed through longitudinal flute channels in the panel, with ends extending through holes in the end plates 82, 83 to receive tighteners such as the nuts 87 shown in FIG. 8**. The rods or cables may be placed under tension by the tighteners, thereby prestressing the member for use as a beam or other horizontal support.

Obviously, the present construction panels may be manufactured in a number of sizes and configurations. Assembly in whatever configuration is used will involve the same basic steps. Firstly, if a footing is to be used, preparation is made and the footing is poured and formed to receive the bottom edges of joined panel members.

Upright tie bars 68 are positioned to be received along a number of the panel rabbets as shown in FIG. 2. Next the panels are lowered into the groove and with the inside corners of the rabbets 27 (FIGS. 2, 4) receiving the upright tie bars 68. Successive panels are placed along the footing with the rabbeted sections fitting together as shown in FIG. 1.

Connecting rods 60 are placed through aligned passages 22 formed by the flutes to complete the structural unit. Additional construction may follow, to form a complete structure using panels and the joining technique just described.

The same basic technique is used with the base plate 65 and headed tie rods. However, there is no need with the base plate to form and pour footings, as the footing is provided by the base plate.

The assembled panels may be selectively secured to the footings or to the base plate by provision of nuts and washers threadably engaged on the top ends of the upright tie rods.

Use of the panel version shown in FIG. 3 involves similar assembly steps as those suggested above, except that the connecting rods are extended through the passages formed by the flutes at substantially perpendicular angles. The intersecting rods will lock the panels together and form a substantially unitary skin, deck, roof, or floor structure.

In compliance with the statute, the invention has been described in language more or less specific as to methodical features. It is to be understood, however, that the invention is not limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A corrugated building component, comprising:

a panel formed of corrugated sheet material with face surfaces and fluted sheet material layers laminated together forming flutes between the face surfaces;

wherein said flutes form passages between the face surfaces;

said fluted sheet material layers being angularly oriented relative to one another such that the passages formed by one fluted sheet material layer are angularly offset from the passages formed by an adjacent fluted sheet material layer such that the passages of one layer transverse the passages of the other layer;

wherein the panel includes at least one peripheral edge;

at least a portion of said peripheral edge being rabbeted; and wherein the open passages are arranged such that at least one set of passages are open along the one peripheral edge.

2. A corrugated building component, as claimed by claim 1 wherein the one set of passages are substantially perpendicular to the one peripheral edge.

3. A corrugated building component, as claimed by claim 1 wherein said passages extend across the panel and include open ends.

4. A corrugated building component, as claimed by claim 1 wherein the panel includes a thickness dimension between the face surfaces, and wherein the rabbet includes a depth dimension from one of the face surfaces equal to approximately one half the thickness dimension of the panel.

5. A corrugated building component, as claimed by claim 1 wherein the panel includes a thickness dimension between the face surfaces; and further comprising two central fluted sheet material layers substantially centered between the face surfaces in which the flutes thereof form parallel passages.

6. A corrugated building component, as claimed by claim 1 wherein the panel includes a thickness dimension between the face surfaces; and further comprising two central fluted sheet material layers substantially centered between the face surfaces in which the flutes thereof form parallel passages; and wherein the parallel passages are substantially perpendicular to the one peripheral edge of the panel.

7. A corrugated building component, as claimed by claim 1 wherein the panel includes opposed ends defined by opposed end edges; and wherein the end edges are rabbeted.

8. A corrugated building component, as claimed by claim 1 wherein the panel is comprised of a first panel member and a second panel member overlapping the first panel member and wherein the second panel includes at least one side edge; and wherein said at least one side edge portion of the second panel member extends beyond the perimeter of the first panel member to form the rabbet.

9. A corrugated building component, as claimed by claim 1 wherein the panel is comprised of:

first and second panel members each including at least one side edge;

wherein the first and second panel members overlap and are secured to one another with at least one side edge portion of the second panel member extending beyond a corresponding side edge of the first panel member to form the rabbet; and wherein the fluted sheet material layers are arranged such that the passages formed adjacent one of the facing surfaces are substantially perpendicular to the passages formed adjacent the remaining facing surface.

10. A corrugated building system, comprising:

a plurality of panels, each formed of corrugated sheet material with face surfaces and fluted sheet material layers laminated together between the face surfaces;

wherein said flutes form first and second sets of passages extending substantially parallel to the face surfaces of each panel;

said fluted sheet material layers being angularly oriented relative to one another such that the first set of passages are angularly offset from the second set of passages to transverse the second set of passages;

wherein each panel includes peripheral edges joined to form a closed configuration and with at least one edge being rabbeted such that successive panels may be joined together with rabbeted edges thereof joined in overlapping relation;

wherein the sets of passages are arranged such that the first set of passages open along the one edge of one panel and align with a corresponding set of passages in an adjacent panel mounted to the one panel along the rabbeted edges thereof; and elongated connecting rods each of a size to be slidably received within the first set of passages and to extend from the one panel into the corresponding set of passages in an adjacent panel, thereby connecting the one panel and said adjacent panel together.

11. A corrugated building system, as claimed by claim 10 further comprising a base plate having a tie bar projecting therefrom with a shank sized to extend between the joined rabbeted edges of two panels, to mount the panels to the base plate.

12. A corrugated building system, as claimed by claim 10 further comprising:

a base plate having a slot formed therethrough;

a tie bar having a headed end and an elongated shank projecting therefrom, sized to extend between the joined rabbeted edges of two panels, to mount the panels to the base plate; and wherein the headed end is shaped to be releasably received through the slot within the base to interlock with the base plate.

13. A corrugated building system, as claimed by claim 10 further comprising a base plate having a tie bar projecting therefrom with a shank sized to extend between the joined rabbeted edges of two panels to mount the panels to the base plate, the shank having a threaded end receiving a nut for clamping against a panel received between the nut and base plate.

14. A corrugated building system, as claimed by claim 10 further comprising:

a base plate with a "T" shaped slot formed therein;

a tie bar having a headed end slidably receivable within the "T" shaped slot and having a shank sized to extend from the base plate between the joined rabbeted edges of two panels.

15. A corrugated building system as claimed by claim 10 further comprising:

a base plate with a reinforcing rib extending along the base plate; and a tie bar mountable to the base plate to extend from the base plate along the panel.

16. A corrugated building system as claimed by claim 10 wherein the peripheral edges include a longitudinal top edge and a longitudinal bottom edge, and transverse end edges; wherein the first set of passages are oriented substantially perpendicular to the end edges; and further comprising:

a rigid bottom plate extending along the bottom edge;

a rigid top plate extending along the top edge;

connecting members joining the bottom and top plates;

end plates engaging the transverse end edges; and reinforcing connectors mounted to the end plates.

17. A corrugated building system as claimed by claim 10 wherein the peripheral edges include a longitudinal top edge and a longitudinal bottom edge, and further comprising:

a rigid bottom plate extending along the bottom edge;

a rigid top plate extending along the top edge; and connecting members joining the bottom and top plates.

18. A corrugated building system, comprising:

a panel formed of corrugated sheet material with face surfaces and fluted layers laminated together between the face surfaces;

wherein the panel includes peripheral edges joined to form an elongated configuration, including longitudinal top and bottom sides joined, and transverse ends;

wherein said flutes form first and second sets of passages extending substantially parallel to the face surfaces of each panel;

said fluted layers being angularly oriented relative to one another such that the first set of passages extend substantially longitudinally between the ends and the second set of passages extend substantially transversely between the top and bottom sides;

a rigid bottom plate extending along the bottom side;

a rigid top plate extending along the top side;

connecting members joining the bottom and top plates;

end plates engaging the transverse end edges; and reinforcing connectors mounted to the end plates and extending through the panel between the ends thereof.

* * * * *